US012643197B2

(12) United States Patent
Wunderlich et al.

(10) Patent No.: US 12,643,197 B2
(45) Date of Patent: Jun. 2, 2026

(54) METHOD FOR CONTROLLING AND/OR MONITORING A WORKPIECE MACHINING PROCESS

(71) Applicant: PRO-MICRON GMBH, Kaufbeuren (DE)

(72) Inventors: Rainer Wunderlich, Kaufbeuren (DE); Martin Dix, Chemnitz (DE)

(73) Assignee: pro-micron GmbH, Kaufbeuren (DE)

( * ) Notice: Subject to any disclaimer, the term of this patent is extended or adjusted under 35 U.S.C. 154(b) by 259 days.

(21) Appl. No.: 18/251,419

(22) PCT Filed: Oct. 27, 2021

(86) PCT No.: PCT/EP2021/079801
§ 371 (c)(1),
(2) Date: May 2, 2023

(87) PCT Pub. No.: WO2022/090304
PCT Pub. Date: May 5, 2022

(65) Prior Publication Data

US 2024/0001507 A1 Jan. 4, 2024

(30) Foreign Application Priority Data

Nov. 2, 2020 (DE) ..... 10 2020 128 811

(51) Int. Cl.
*B24B 51/00* (2006.01)

(52) U.S. Cl.
CPC ..... *B24B 51/00* (2013.01)

(58) Field of Classification Search
CPC .... B24B 5/18; B24B 5/04; B24B 5/02; B24B 5/30; B24B 5/307; B24B 5/363; B24B 5/37; B24B 5/42
See application file for complete search history.

(56) References Cited

U.S. PATENT DOCUMENTS 3,905,161 A * 9/1975 Tomita ..... B24B 47/20 451/26
4,371,942 A * 2/1983 Damikolas ..... G05B 19/4166 700/192

(Continued)

FOREIGN PATENT DOCUMENTS

CN 104684683 A 6/2015
CN 109202720 A 1/2019

(Continued)

*Primary Examiner* — Joel D Crandall
(74) *Attorney, Agent, or Firm* — Corinne R. Gorski

(57) ABSTRACT

A method for controlling and/or monitoring a workpiece machining process where a tool having a working surface is brought into contact with a surface of a workpiece to be machined via a feed movement. In the machining process, the tool and/or workpiece rotate about a tool axis and/or workpiece axis. The feed movement occurs while the tool and/or workpiece are rotating and an auxiliary medium is introduced into a region between a working surface of the tool and a surface of the workpiece to be machined. Bending moments and/or forces acting transversely to the tool axis or workpiece axis and/or torques occurring during rotation of the tool about the tool axis and/or during rotation of the workpiece about the workpiece axis are captured in a time-resolved manner. A status of the approach process is inferred from the values and/or time profiles of the captured bending moments, forces and/or torques.

9 Claims, 1 Drawing Sheet

(56) References Cited

U.S. PATENT DOCUMENTS 4,662,122 A * 5/1987 Ohmura ..... G05B 19/4166 451/5
5,025,594 A * 6/1991 Lambert, Jr. ..... B24B 49/16 451/21

FOREIGN PATENT DOCUMENTS

| | | | |
|---|---|---|---|
| CN | 109202720 | B | 8/2021 |
| DE | 27787 | A3 | 11/1959 |
| DE | 141000 | A1 | 4/1980 |
| DE | 219421 | A1 | 3/1985 |
| DE | 102007063200 | A1 | 6/2009 |
| EP | 0023547 | A1 | 2/1981 |
| EP | 0249803 | A1 | 12/1987 |
| EP | 0304907 | A2 | 3/1989 |
| EP | 2103379 | B1 | 9/2009 |
| EP | 2316612 | A2 | 5/2011 |
| EP | 2924526 | B1 | 9/2015 |
| JP | S61252071 | A | 11/1986 |
| JP | H07256542 | | 10/1995 |
| JP | H10329019 | A | 12/1998 |
| JP | H11221757 | A | 8/1999 |
| JP | 200425504 | A | 9/2004 |
| JP | 2013031915 | | 2/2013 |
| WO | 2022090301 | A1 | 5/2022 |

* cited by examiner

METHOD FOR CONTROLLING AND/OR MONITORING A WORKPIECE MACHINING PROCESS

TECHNICAL FIELD

The invention relates to a method for controlling and/or monitoring a workpiece machining process with the features of being a cutting workpiece machining process, in which workpiece machining process a tool having a working surface is brought into contact with a surface of a workpiece to be machined, and for this purpose, a feed movement for the relative approach of the tool and the workpiece is carried out, wherein the tool and/or the workpiece rotate about a tool axis and/or workpiece axis and the feed movement is carried out while the tool and/or workpiece are rotating, and wherein at least while the feed movement is performed, an auxiliary medium is introduced at least into a region between the working surface of the tool and the surface of the workpiece to be machined.

BACKGROUND ART

In workpiece machining, in particular in the automated machining of workpieces, in particular when carrying out material-cutting workpiece machining, such as milling, turning, drilling and grinding, high throughput numbers are nowadays required on the one hand for the machining of workpieces in high quantities, and on the other hand, there are usually high demands on the machining quality, for example on the surface quality and on shape and position tolerances to be observed. In order to meet these requirements, it is known to capture, in particular also dynamically, in automatedly guided machining processes, the process of workpiece machining with different characteristic variables and to in turn draw conclusions from the characteristic variables, for example, with regard to the success or failure of the machining process or to a state of the machining tool, the workpiece or the machining machine, for example a milling machine.

For example, there is a tool holder developed by the applicant with an integrated measuring sensor system, which is described, for example, in EP 2 103 379 B1. With the latter, reaction forces and bending moments arising from a tool engagement can be determined during machining in a milling process. Measured values recorded by such a sensor system in a tool holder can then be evaluated, for example, as described in EP 2 924 526 B1 likewise originating from the applicant, in order to detect, for example, tool wear in a manner resolved according to individual tool cutting edges of a milling tool, or also a cutting edge break.

Other methods, likewise existing on the market, for observing and evaluating machining processes rely on capturing and evaluating the current consumption, i.e., the current intensity of the electrical current consumed by a drive motor for driving a spindle, for example a tool spindle, wherein changes of torques can, for example, be inferred from the measured data for the current consumption.

For further improvement of the capturing and monitoring of workpiece machining processes, further developments are necessary in order to also be able to capture and analyze additional states, variables and conditions in workpiece machining processes and also to be able to subject other and additional forms of workpiece machining processes, in particular during cutting workpiece machining processes, to a corresponding monitoring and analysis. Advantageously, accordingly obtained data and knowledge can then also be used for controlling the processes, in particular in near real time.

For example, for grinding machining, it is of interest to determine very precisely when a rotating grinding tool comes into contact with the workpiece to be machined during a feeding process. This information is important for carrying out a change of increased movement speed during the tool advance without workpiece contact to the very low infeed speed customary during grinding. Due to the tolerances of the unmachined workpiece, which can be in the range of tenths of a millimeter, a long approach phase with a low infeed speed (also feed speed or approach speed) is required if there is no approach control which controls the start of the process. Bringing a grinding tool into contact with a workpiece to be machined, the so-called initial contact, is a critical moment in the grinding machining process since a minimal time requirement and high grinding allowance tolerances must be combined for efficient manufacturing. Here, the feed movement, with which the grinding tool and the workpiece are brought closer to one another, must not be performed at too high a speed at the moment of contact so that the grinding tool does not suddenly and abruptly impinge on the surface of the workpiece to be machined. Such an abrupt impingement can result in microscopic and macroscopic changes in the grinding tool, which in turn lead to scratches or other unwanted manufacturing defects on the workpiece surface and have negative effects on the shape and position tolerances. Since grinding machining generally represents a final workpiece machining process, such scratches or other damage to the surface can often not be removed again in a continued grinding process without violating the specified geometric target variables in the process. Accordingly, workpieces with such surface defects are often rejects. A further risk when the workpiece and the grinding tool impinge on one another too abruptly within the scope of the feed movement consists in possible damage, for example a break, of the grinding tool. On the other hand, a rapid feed movement is desired for the highest possible workpiece throughput. Accordingly, there are already suggestions to reduce the speed of a feed movement in grinding processes starting from a first part carried out quickly, which is traversed, for example, at a rapid traverse speed, to a working speed in a second part. However, this frequently occurs only after workpiece contact has occurred. One way of providing a corresponding control, which, for example, resorts to measuring the electrical grinding motor power, is described in DD-PS-141 000.

SUMMARY OF THE INVENTION

The present invention is to disclose further and improved possibilities of how workpiece machining processes can be monitored and/or controlled using a sensor system for the time-resolved capture of bending moments and/or forces and with recourse to the characteristic values ascertained by this sensor system.

This object is achieved according to the invention by a method for controlling and/or monitoring a workpiece machining process, in particular a material-cutting workpiece machining process, in which workpiece machining process a tool having a working surface may be brought into contact with a surface of a workpiece to be machined, and for this purpose, a feed movement for the relative approach of the tool and the workpiece may be carried out, wherein the tool and/or the workpiece may rotate about a tool axis and/or workpiece axis and the feed movement may be carried out while the tool and/or workpiece are rotating, and wherein at least while the feed movement is performed, an auxiliary medium may be introduced at least into a region between the working surface of the tool and the surface of the workpiece to be machined, characterized in that, during the feed movement, bending moments and/or forces acting transversely, in particular orthogonally, to the tool axis and/or transversely, in particular orthogonally, to the workpiece axis and/or torques occurring during the rotation of the tool about the tool axis and/or during the rotation of the workpiece about the workpiece axis may be captured in a time-resolved manner, and in that a status of the approach process may be inferred from the values and/or time profiles of the captured bending moments and/or forces and/or torques. Advantageous developments of such a method include that bending moments, forces and/or torques caused by a reaction force acting in a direction different from the direction of the feed movement as a result of the presence of the auxiliary medium in the region between the surface of the workpiece to be machined and the working surface of the tool may be detected, and in that on the basis of these bending moments, forces and/or torques detected in this way, a status of the workpiece machining process may be inferred. The method may be characterized in that, due to a first increasing behavior of the captured bending moments, forces and/or torques, an approach of the tool and the workpiece to a threshold distance may be detected. An advance speed of the feed movement may be reduced when an approach of the tool and workpiece to the threshold distance is detected. Further feed movement at the reduced advance speed may be performed at least until contact between the tool and the workpiece occurs. Solid contact of the tool on the workpiece may be detected based on a second increasing behavior of the captured bending moments, forces and/or torques. The method may further be characterized in that the presence of the auxiliary medium in the region between the tool and the workpiece may be detected based on a third increasing behavior of the captured bending moments, forces and/or torques. The method may further be characterized in that the time-resolved capture of bending moments, forces and/or torques may take place by means of a sensor arrangement, having force or deformation sensors, in a tool holder and/or in a workpiece holder and/or in a machine tool spindle assembly equipped with a sensor system. The method may further be characterized in that the workpiece machining process may be a grinding process and the tool may be a grinding tool, in particular a rotating grinding disk or grinding pin.

The invention thus initially provides, in its general form, a method for controlling and/or monitoring a workpiece machining process, in particular a material-cutting workpiece machining process, in which workpiece machining process a tool having a working surface is brought into contact with a surface of a workpiece to be machined and, for this purpose, a feed movement is carried out for the relative approach of the tool and the workpiece, and in which workpiece machining process the tool and/or workpiece is furthermore rotated about a tool axis and/or workpiece axis and the feed movement is carried out while the tool is rotating and/or while the workpiece is rotating, and in which workpiece machining process an auxiliary medium is also introduced at least into a region between the working surface of the tool and the surface of the workpiece to be machined at least while the feed movement is carried out. The auxiliary medium introduced can in particular be a fluid, for example a liquid, such as a cooling fluid, a cooling liquid, or a fluid for discharging material particles, such as chips or grinding dust, detached from the workpiece in a material-cutting workpiece machining process.

According to the present invention, during the feed movement, bending moments and/or forces acting transversely, in particular orthogonally, to the tool axis and/or transversely, in particular orthogonally, to the workpiece axis and/or torques occurring during the rotation of the tool about the tool axis and/or during the rotation of the workpiece about the workpiece axis are captured in a time-resolved manner. From the values and/or from the time profiles of the captured bending moments, forces and/or torques, a status of bringing the tool with its working surface closer to the workpiece body is then inferred.

Thus, within the scope of the invention, a feed movement of the tool relative to the workpiece is already considered, and during this feed movement, forces and/or bending moments acting on the tool and/or workpiece transversely, in particular orthogonally, to the respective axis of the tool and/or the workpiece and/or torques occurring during the rotation of the tool about the tool axis and/or during the rotation of the workpiece about the workpiece axis are captured using measurement technology. Based on absolute values of the captured characteristic variables (bending moments, forces and/or torques) or else based on time profiles of these characteristic variables, conclusions are then drawn about a status of the approach between the tool and the workpiece.

Thus, for example, a tool rotating about the tool axis can be guided to a stationary workpiece or a workpiece moved at the advance speed, and the forces and/or bending moments acting on the tool transversely, in particular orthogonally, to the tool axis can be captured and evaluated in the manner described above. It is also possible to bring a tool rotating about a tool axis closer to a workpiece rotating about the workpiece axis, and the forces and/or bending moments acting on the tool transversely, in particular orthogonally, to the tool axis can be captured and evaluated in the manner described above. However, alternatively or additionally, the aforementioned torques may also be captured and evaluated for the determination of the approach.

With the measure according to the invention, it is possible, in particular even before the start of the actual material removal, i.e., before solid contact of the tool with the workpiece to be machined, to capture and determine particular states of the process that in particular arise during the feed movement, i.e., a relative approach between the tool and the workpiece. This enables early intervention if deviations from an expected state are determined. In addition, such knowledge of states in turn allows control of the machining process even before the engagement between the tool and the workpiece, for example by adapting a feed speed of a feed movement when the workpiece and tool have approached to a predetermined limit distance detected based on a change in the values, captured by the sensor system, of the bending moments and/or forces.

In particular, the presence of the auxiliary medium in the region between the surface of the workpiece to be machined and the working surface of the tool can be utilized for the method according to the invention. This is because, within the scope of a feed movement, this auxiliary medium, for example a cooling fluid, has the result that a reaction force acting in a direction different from the direction of the feed movement is generated due to the auxiliary medium present in the gap between the tool and the workpiece and is transmitted to or acts on the workpiece and the tool. For example, such an auxiliary medium in the gap formed between the workpiece and the tool is entrained by a rotation of the tool and/or of the workpiece and in turn generates a corresponding force or a corresponding pressure transversely to the axis of the workpiece and/or tool about which the relevant element rotates, an acting force on the respectively other element of the tool or workpiece if the gap existing between the workpiece and the tool is sufficiently small. Likewise, a torque braking the rotation of the respective element, i.e., tool or workpiece, is generated. Thus, if such a force acting transversely to the respective axis on the workpiece or on the tool and/or a corresponding bending moment and/or a torque as explained above is detected with the aid of the sensor system used, an approach of the tool and the workpiece to a threshold distance can be inferred from the start of this force, the bending moment and/or the torque or from a corresponding increase in the values of the mentioned parameters. This detection of a threshold distance can then be used, for example, to reduce the speed of the feed movement, for example starting from a rapid traverse now to a working advance speed in order to exclude load peaks during the first contact between the tool and the workpiece. This reduced advance speed can then be maintained until an actual contact between the tool and the workpiece is determined.

Such an actual contact again causes a change in the bending moments and/or forces ascertained with the measuring sensor system and acting transversely to the relevant axis, i.e., tool axis or workpiece axis, or an increase in the torque braking the respective rotational movement of the tool or workpiece. In comparison to a force transmitted due to the effect described above of entrainment of the auxiliary medium, a distinct and significant increase in the corresponding force (forces) or the corresponding bending moments or the corresponding torques can be determined here so that the actual contact and engagement of the tool with the workpiece can also be detected with the method according to the invention.

Moreover, in the case of a distance between the tool and the workpiece that is reduced to such an extent that, due to the auxiliary medium, a transmission of forces and/or bending moments to, for example, the tool takes place, or that a torque braking the rotation of, for example, the tool occurs, a true run or deviations from a true run of the tool can be inferred from values of the forces, bending moments and/or torques captured in a time-resolved manner at high frequency. This is because if deviations in the pattern of the forces, bending moments and/or torques measured in a time-resolved manner arise that do not match a geometry of the tool at its peripheral outer contour, e.g., the circular shape of a grinding disk, a deviation from the desired true run can be inferred. The same applies to a check of the true run of the workpiece if the latter is also rotating.

Due to the above-described effect, namely a transmission of a force directed transversely to the relevant axis of the workpiece or the tool, or a bending moment acting transversely, in particular orthogonally, to the respective axis, or the transmission of a torque braking the respective rotation of the tool and/or workpiece, by the auxiliary medium conveying this force during an approach, it is also possible to infer, if the resulting pattern in the time profile of the captured forces, bending moments or torques is absent, that an auxiliary medium is not present, or at least is not present to a sufficient extent, for example with too low a medium pressure, i.e., that a corresponding error is present in the machining process.

In order to carry out the method according to the invention, it is of significant importance to sensitively capture, at a detailed resolution, the forces, bending moments and/or torques to be determined, in particular when minute changes in the time profile of these characteristic variables are to be detected and reliably determined. In order to obtain this sensitivity and measurement accuracy, it is proposed to carry out the time-resolved capture of bending moments, forces and/or torques with a sensor arrangement, having force or deformation sensors, in a tool holder and/or a workpiece holder and/or with a spindle equipped with a sensor system. For example, a holder as described in EP 2 103 379 B1 of the present applicant may be used here. With a corresponding sensor system, which may be arranged, for example, in a tool holder or a spindle nose, forces or bending moments acting in particular on the element held therein, e.g., the tool, in particular forces or bending moments directed transversely to the axis about which the element, e.g., the tool, is rotating, can be captured particularly well at a high resolution. In particular, the capture of forces and/or bending moments with such instruments is possible in a substantially more accurate and better time-resolved manner than a capture, for example by evaluation of the motor current or with other indirect sensor means. The direct and high-resolution capture of the values for acting forces and/or bending moments and/or torques then allows a very exact analysis, in particular of the time profile of these characteristic values, in order to accordingly already detect the above-described phenomena in the feed phase and to be able to infer corresponding states of the machining process.

Even if the method according to the invention can basically be used for very different workpiece machining processes, it is particularly suitable for use in connection with a grinding process, in particular a grinding process with a geometrically rigid grinding tool, preferably a rotating grinding disk or such a grinding pin. In such a grinding process, the reaching of a threshold value for the distance between the grinding tool and the workpiece, detected by means of the method according to the invention based on the force transmitted, for example, from the workpiece to the grinding tool by the auxiliary medium introduced between the grinding tool and the workpiece, or a resulting bending moment or also a transmitted braking torque, can in particular be used to better and more reliably control the so-called initial contact process, i.e., feeding and bringing the grinding tool into contact with the workpiece. This threshold value can, for example, be at a distance between the grinding tool and the workpiece surface in an order of magnitude of 10 to 50 μm.

In this way, in such a process, a grinding tool, for example a rotating grinding disk for peripheral grinding, can initially be moved close to the workpiece or to the surface of the workpiece to be machined, with a fast feed movement, for example, a feed movement at a speed in an order of magnitude of greater than mm/min, until the above-described effect, caused by the entrained auxiliary medium, of a transmission of a transversely directed force or a corresponding bending moment or a torque occurs and is detected, whereupon the feed speed is then reduced and the further feeding of the tool to the workpiece takes place with a correspondingly slower working speed or a working speed in an order of magnitude of less than 6 mm/min until a soft engagement with the workpiece surface is achieved. In this way, the feed movement required at the beginning of the machining process can be shortened in its duration without the risk that a hard and abrupt engagement and solid contact of the grinding tool with the surface of the workpiece to be machined takes place. This makes it possible to increase the throughput of machined workpieces as a result of reduced nonproductive secondary times, without this being associated with the risk of decreased machining quality, but rather a quality control takes place.

However, the method can also be used to center a machining tool, such as a rotating milling cutter or a grinding tool for internally grinding bores or the like, in the feed movement. For this purpose, bending moments or torques can be evaluated on the basis of a capture of the reaction forces occurring during the feed movement and, in particular, caused by an interaction as described above with the auxiliary medium in the approach, and the feed movement for centering can then be adjusted such that the reaction forces or bending moments are, for example, minimized, in particular reduced to zero, or that the values and/or profiles of the reaction forces, bending moments and/or torques correspond to a particular pattern.

In particular, in a method according to the invention, the capture of forces, also force components, and/or bending moments, also bending moment components, can take place in more than one dimension and the values and profiles captured for a plurality of dimensions, for example for two dimensions, can accordingly be evaluated in order to infer a status of the machining process.

BRIEF DESCRIPTION OF THE DRAWINGS

Further advantages and features of the invention become apparent from the following explanation of possible embodiments with reference to the accompanying figures. In the figures.

In the figures, representations are provided purely schematically and without any scale to illustrate the invention.

DETAILED DESCRIPTION

Figure 1:
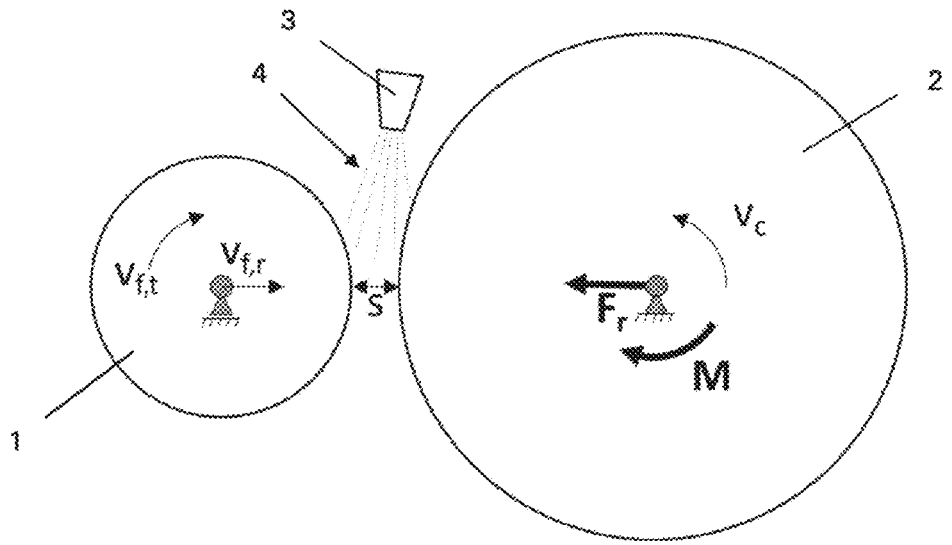
FIG. 1 shows a schematic representation of an arrangement of a workpiece and a machining tool in a tool approach process.

FIG. 1 schematically shows the conditions in a processing device, as are present during the approach of a workpiece 1 and a tool 2 relative to one another. The tool 2 can in particular be a grinding disk.

For approaching and for starting the machining, in particular cutting, workpiece 1 and/or tool 2 are set into rotation, wherein they form a gap S, have a distance from one another. In the case shown, the workpiece 1 is rotating at a rotational speed $v_{f,t}$, and the tool 2 is rotating at a rotational speed $v_c$. An auxiliary medium 4, for example a liquid, is introduced into the gap S from a supply 3.

The workpiece 1 and the tool 2 are now brought closer to one another at a radial feed speed $v_{f,r}$, the distance, i.e., the width of the gap S left between the workpiece 1 and the tool 2, i.e., the grinding gap in the case of grinding machining, thus being reduced. This initially takes place at a high feed speed $v_{f,r}$ in order to save process time here. In order to obtain this radial feed movement, the workpiece 1 and/or the workpiece 2 can be actively moved. Solely important is that a relative movement in the radial direction between the workpiece 1 and the tool 2 is initiated.

Even before solid contact between the workpiece 1 and the tool 2, a coupling between the workpiece 1 and the tool 2 is obtained via the medium located in the gap S, such as in particular the auxiliary medium 4, which coupling then results in an occurrence of a radial force $F_r$, a torque M, which is in particular braking, and also a bending moment $B_M$ (see also FIG. 2) on the tool 2. Corresponding counterforces and countermoments on the workpiece 1 can then be observed.

It is now the approach of this invention to measure at least one of these variables, i.e., the force $F_r$, torque M or bending moment $B_M$, on the workpiece 1 and/or the tool 2 and to infer a degree of approach between the workpiece 1 and the tool 2 from the values and/or the time profile of these values. This measurement can basically take place on the workpiece 1 and/or on the tool 2. Currently, the inventors prefer a measurement on the tool 2.

If the values or a profile of the values of the aforementioned measured variable(s) reveal that an approach between workpiece 1 and tool 2 has taken place up to a distance from which a reduction of the radial feed speed $v_{f,r}$ is required, the latter is caused by a machine controller in this way.

Figure 2:
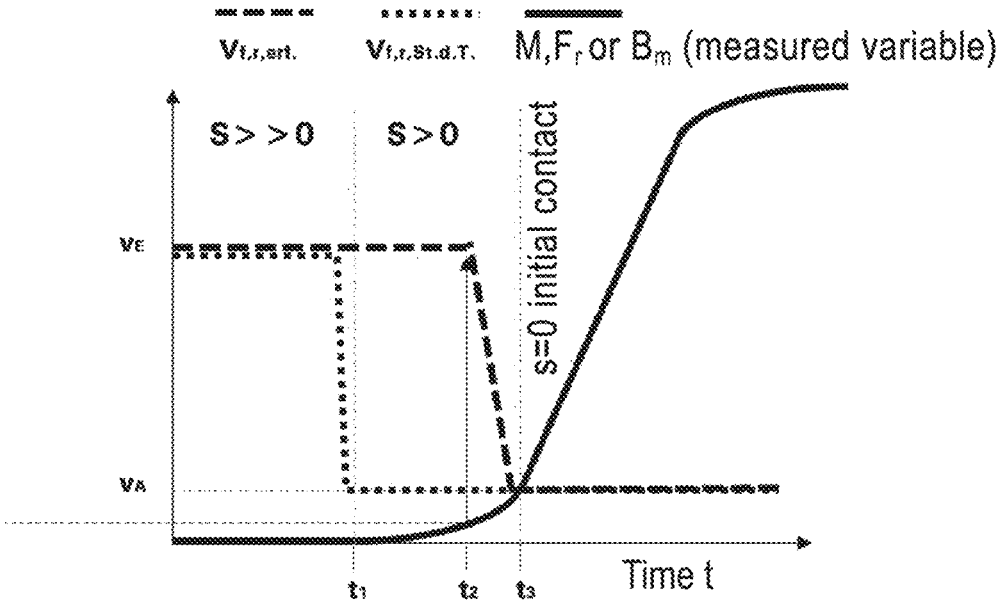
FIG. 2 shows a representation, plotted over the time axis, of the adjustment of the approach speeds for the feeding during a grinding process in a procedure known from the prior art and when the method according to the invention is carried out, and also a representation of the profile of a measured value of a measured variable used for the control according to the invention of the approach speed.

This basic sequence is illustrated in FIG. 2 by way of example for a grinding process and is shown in comparison to a procedure known from the prior art. However, the representation in FIG. 2, in the basic mode of operation, can also be transferred to other cutting processes.

FIG. 2 shows, in a highly schematic manner, profiles of process variables plotted over the time t.

The dotted line denoted by $v_{f,r,St.d.T}$ in the legend above the representation schematically indicates the time profile of the radial feed speed $v_{f,r}$ in a procedure according to the prior art. There, with a still large gap S (here illustrated with S>>0) between tool and workpiece, the radial approach or feed movement is initially performed at a comparatively high rapid speed $v_E$ of, for example, 60 mm/min until the tool and the workpiece have approached one another to a specified small distance, typically somewhat above the tolerance dimensions given from a previous production step, at which distance the gap S is correspondingly reduced (here illustrated with S>0), which is the case at a time point $t_1$. Upon reaching this distance specified in the control, i.e., from the time point $t_1$, the further feed movement until initial contact, which takes place at the time point $t_3$ when the gap width 0 is reached, is then performed only at the significantly reduced working speed, which may, for example, be 5 mm/min. During braking, as can be seen in the figure, a speed ramp can be maintained.

In comparison thereto, the dashed line denoted by $v_{f,r,Erf}$ in the legend of FIG. 2 shown above the representation schematically represents the profile of the radial feed speed $v_{f,r}$ in a procedure according to the invention. In this case, the adjustment of the radial feed speed $v_{f,r}$ does not follow, as in the case of a procedure known from the prior art and illustrated by the dotted line, a specified distance control determined based on tolerance dimensions, but is performed, for each workpiece to be machined, in each case independently on the basis of measured values, ascertained during the feeding, of a bending moment $B_m$ acting on the tool and/or the workpiece in a direction transverse to the tool axis or the workpiece axis, or of a force $F_r$ acting transversely to the tool axis or workpiece axis, or also on the basis of an ascertained torque M. The time profile of such a measured value is illustrated schematically with the solid line in the figure. It can be seen that the measured value is initially constant and low and increases from a time point after the time point $t_1$. At the time point $t_2$, this profile then exceeds a previously defined threshold value so that the feed speed is then lowered from the rapid speed $v_E$ to the working speed $v_A$, again in a ramp until the initial contact at the working speed $v_A$ then takes place at a gap width 0 at the time point $t_3$.

Illustrated in FIG. 2 is in particular that, in the method according to the invention, in comparison to the method known from the prior art, the feed movement at the higher rapid speed $v_E$ can be carried out for a longer time and thus spatially up to a narrower gap S. This is possible since the specification of a lowering of the feed speed does not have to take place on the basis of a distance value, which is based on tolerance values of the dimensions of the workpieces to be machined and frequently also provided with a safety margin, at a comparatively early time point $t_1$ but can be performed individually for each workpiece on the basis of the determination of an actual approach as described above and therefore regularly at smaller gap widths and thus at a later time point $t_2$. Since the rapid speed $v_E$ is significantly higher than the working speed $v_A$, typically ten times or even higher, the procedure according to the invention thus results in an overall shortened feed duration until the initial contact. In particular in processes of mass production, this ultimately leads to a higher throughput and thus to reduced production costs.

LIST OF REFERENCE SIGNS

1 Workpiece
2 Tool
3 Supply
4 Auxiliary medium
$B_M$ Bending moment
$F_r$ Radial force
M Moment
S Gap
$t_1$, $t_2$, $t_3$ Time point
$v_A$ Working speed
$v_E$ Rapid speed
$v_{f,t}$ Rotational speed of the workpiece
$v_{f,r}$ Radial feed speed
$V_c$ Rotational speed of the tool

The invention claimed is:

1. A method for controlling a workpiece machining process, the method comprising:

bringing a tool having a working surface into contact with a surface of a workpiece to be machined, wherein a feed movement for a relative approach of the tool and the workpiece is carried out, wherein the tool rotates about a tool axis and/or the workpiece rotates about a workpiece axis and the feed movement is carried out while the tool and/or the workpiece are rotating;

introducing, at least while the feed movement is performed, an auxiliary medium at least into a region between the working surface of the tool and the surface of the workpiece to be machined;

capturing, in a time-resolved manner during the feed movement, bending moments acting transversely to the tool axis and/or transversely to the workpiece axis, forces acting transversely to the tool axis and/or transversely to the workpiece axis and/or torques occurring during the rotation of the tool about the tool axis and/or during the rotation of the workpiece about the workpiece axis; and detecting the relative approach of the tool and the workpiece to a threshold distance greater than zero by identifying that one or more captured values of the bending moments, forces, and/or torques exceed a previously defined first threshold value; and reducing an advance speed of the feed movement when the relative approach of the tool and the workpiece to the threshold distance is detected.

2. A method according to claim 1, wherein the bending moments, forces and/or torques caused by a reaction force acting in a direction different from a direction of the feed movement as a result of the presence of the auxiliary medium in the region between the working surface of the tool and the surface of the workpiece to be machined are detected, and wherein on a basis of the detected bending moments, forces and/or torques, the status of the workpiece machining process is inferred.

3. The method according to claim 1, wherein further feed movement at the reduced advance speed is performed at least until contact between the tool and the workpiece occurs.

4. The method according to claim 1, further comprising the step of detecting contact of the tool on the workpiece by identifying that one or more captured values of the bending moments, forces and/or torques exceed a previously defined second threshold value.

5. The method according to claim 1, wherein the time-resolved capture of bending moments, forces and/or torques takes place by means of a sensor arrangement having force or deformation sensors located in a tool holder in a workpiece holder, and/or in a machine tool spindle assembly.

6. The method according to claim 1, wherein the workpiece machining process is a grinding process and the tool is a grinding tool.

7. The method according to claim 1, wherein during the feed movement, bending moments and/or forces act orthogonally to the tool axis.

8. The method according to claim 1, wherein during the feed movement, bending moments and/or forces act orthogonally to the workpiece axis.

9. The method according to claim 6, wherein the grinding tool is a rotating grinding disk or a grinding pin.

* * * * *